US007354283B2

(12) United States Patent
Onuma et al.

(10) Patent No.: US 7,354,283 B2
(45) Date of Patent: Apr. 8, 2008

(54) WIRE-CONNECTING DEVICE

(75) Inventors: Masanori Onuma, Shizuoka (JP); Tadahisa Sakaguchi, Shizuoka (JP); Jun Uchida, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/492,051

(22) Filed: Jul. 25, 2006

(65) Prior Publication Data

US 2007/0072455 A1 Mar. 29, 2007

(30) Foreign Application Priority Data

Sep. 29, 2005 (JP) ..... 2005-283396
Oct. 5, 2005 (JP) ..... 2005-292121

(51) Int. Cl.
*H01R 4/66* (2006.01)

(52) U.S. Cl. ..... 439/92; 439/932

(58) Field of Classification Search ..... 439/98, 439/932, 399, 397, 394, 881, 582, 730, 741, 439/287, 386, 284, 578, 92; 174/84 C
See application file for complete search history.

(56) References Cited

U.S. PATENT DOCUMENTS 3,708,611 A * 1/1973 Dinger ..... 174/84 C
3,852,517 A * 12/1974 Fava ..... 174/84 R
4,583,069 A * 4/1986 Pierce ..... 337/240
6,476,325 B2 * 11/2002 Kondo ..... 174/84 C
6,677,529 B1 * 1/2004 Endacott ..... 174/84 R

FOREIGN PATENT DOCUMENTS

JP 2004040867 A * 2/2004

* cited by examiner

*Primary Examiner*—Edwin A. Leon
(74) *Attorney, Agent, or Firm*—Kratz, Quintos & Hanson, LLP

(57) ABSTRACT

A wire-connecting device including a joint terminal for connecting an inner conductor of a coaxial cable and a core wire of an electric wire, and a heat-shrinkable member for covering at least the joint terminal and a cut edge of a braided wire of the coaxial cable exposed at the joint terminal.

6 Claims, 5 Drawing Sheets

WIRE-CONNECTING DEVICE

CROSS-REFERENCE TO RELATED APPLICATIONS

This application is based on Japanese Patent Applications No. 2005-292121 and No. 2005-283396, the contents of which are hereby incorporated by reference.

BACKGROUND OF THE INVENTION

1. Field of the Invention

The present invention relates to a wire-connecting device, in particular, the wire-connecting device having a joint terminal for electrically connecting an inner conductor of a coaxial cable to core wire of an electric wire.

2. Description of the Related Art

FIG. 6 is a partially perspective view of a conventional wire-connecting device. FIG. 7 is an exploded perspective view of the wire-connecting device in FIG. 6. As shown in FIGS. 6 and 7, the wire-connecting device 100 includes a coaxial cable 110, a lead wire 120, a crimp contact 130, an earth plate 140, a shell 150, an insulator 160.

The coaxial cable 110 is, for example, a cable for connecting an antenna mounted on a vehicle. The coaxial cable 110 includes, as well-known, an inner conductor 111, a braided wire 112 surrounding the conductor 111, an insulator 113 interposed between the conductor 111 and the braided wire 112 and made of such as polyethylene, and a coating 114 surrounding the braided wire 112 and made of such as synthetic resin.

The lead wire 120 includes a plurality of core wire 121 made of copper, aluminum, or the like, and an insulator 122 covering the core wire 121. The crimp contact 130 is formed of a metallic hollow cylinder. In the cylinder, the inner conductor 111 of the coaxial cable 110 and the core wire 121 of the lead wire 120 are face to face and crimped together so that the inner conductor 111 and the core wire 121 are electrically connected to each other.

The earth plate 140 includes a substantially square-shaped fixed plate 141 formed by, for example, pressing a conductive metal plate. A hole 142 is formed on a middle of the fixed plate for fixing the earth plate 140 to such as a vehicle body with a not-shown screw. A hollow cylinder 143 is formed at an edge of the fixed plate 141. An internal diameter of the cylinder 143 is substantially equal to an outer diameter of the shell 150 so that the shell 150 can be inserted into the cylinder 143. A hole for soldering the earth plate 140 with the shell 150 is formed on the center of the cylinder 143.

The shell 150 is a hollow cylinder made of conductive metal. One opening 151 of the shell 150 is made smaller than an internal diameter of the shell 150. The insulator 160 is received in the shell 150. The insulator 160 includes a first cylinder 161 projecting outward from the opening 151, a second cylinder 162 having an outer diameter being larger than the first cylinder 161 and substantially the same as the inner diameter of the shell 150, and a step 163 interposed between the first and second cylinders 161, 162.

Next, an assembling embodiment of the wire-connecting device 100 will be explained. First, the lead wire 120 is inserted through the shell 150 and the insulator 160 sequentially. Then, the coaxial cable 110 and the lead wire 120 are inserted into the crimp contact 130 so that the core wire 121 and the inner conductor 111 are face to face in the crimp contact 130. Then, the crimp contact 130 is crimped so that the coaxial cable 110 and the lead wire 120 are electrically connected to each other.

After the coaxial cable 110 is inserted into an insulating sleeve 170, the braided wire 112 is folded to cover the sleeve 170. Then, the insulator 160 covers the crimp contact 130, and the shell 150 covers the insulator 160, so that the step 163 contacts an edge of the opening 151. Resultingly, while the first cylinder projects outward from the shell 150, the insulator 160 is received in the shell 150. Simultaneously, while the shell 150 contacts the braided wire 112, the coaxial cable 110 is partially received in the shell 150.

The folded braided wire 112 of the coaxial cable 110 and the insulator 122 of the lead wire 120 are crimped together. Then, the shell 150 is positioned inside the cylinder 143 and solder is inserted into a hole 144 of the cylinder 143, so that the shell 150 and the earth plate 140 are electrically connected to each other. Resultingly, the braided wire 112 of the coaxial cable 110 is connected to the earth plate 140 and grounded to the vehicle body through the earth plate 140. Incidentally, no document has disclosed such a wire-connecting device 100.

In the wire-connecting device 100, folding the braided wire 112 is necessary, or else an unbound end part of the braided wire 112 may be short-circuited, and crimping strength between the coaxial cable 110 and the lead wire 120 may be reduced. Further, the cylinder 143, the shell 150, and the insulator 160 are needed for connecting the coaxial cable 110 and the lead wire 120 to the earth plate 140. Further, soldering process is needed.

Accordingly, an object of the present invention is to provide a wire-connecting device that prevents connecting strength between the coaxial cable 110 and the lead wire 120 from being reduced, and reduces the number of components thereof, and makes connecting and grounding processes easy.

SUMMERY OF THE INVENTION

In order to attain the object, according to the present invention, there is provided a wire-connecting device including a joint terminal for connecting an inner conductor of a coaxial cable and a core wire of an electric wire, and a heat-shrinkable member to be shrunk so as to cover at least the joint terminal and a cut edge of a braided wire of the coaxial cable exposed at the joint terminal.

Preferably, the heat-shrinkable member is transparent to make an inside thereof visible.

Preferably, the wire-connecting device further including an earth plate having a crimping part for crimping the braided wire exposed from the heat-shrinkable member for grounding and a fixing part extending from the crimping part to be fixed on a mating member.

Preferably, the earth plate further includes clamping parts for clamping coatings of the electric wire and the coaxial cable, and a fixing part to be fixed while holding the coaxial cable and the electric wire.

Preferably, a pair of the clamping parts are extended from the fixing part along the coaxial cable and the electric wire, each of said clamping parts disposed in the same interval to the crimping part.

Preferably, each clamping part has an extending part extended from the fixing part along the coaxial cable and the electric wire, a base extending vertically from an edge of the extending part, a clamping piece being narrower than the base, and extending from the base, and a recess disposed in the vicinity of the clamping piece.

According to the above, the recess prevents the base from being deformed or cracked.

Preferably, an interval between the bases of the clamping parts are narrower than a width of the fixing part along the coaxial cable and the electric wire.

These and other objects, features, and advantages of the present invention will become more apparent upon reading of the following detailed description along with the accompanied drawings.

DETAILED DESCRIPTION OF THE PREFERRED EMBODIMENTS

Figure 1:
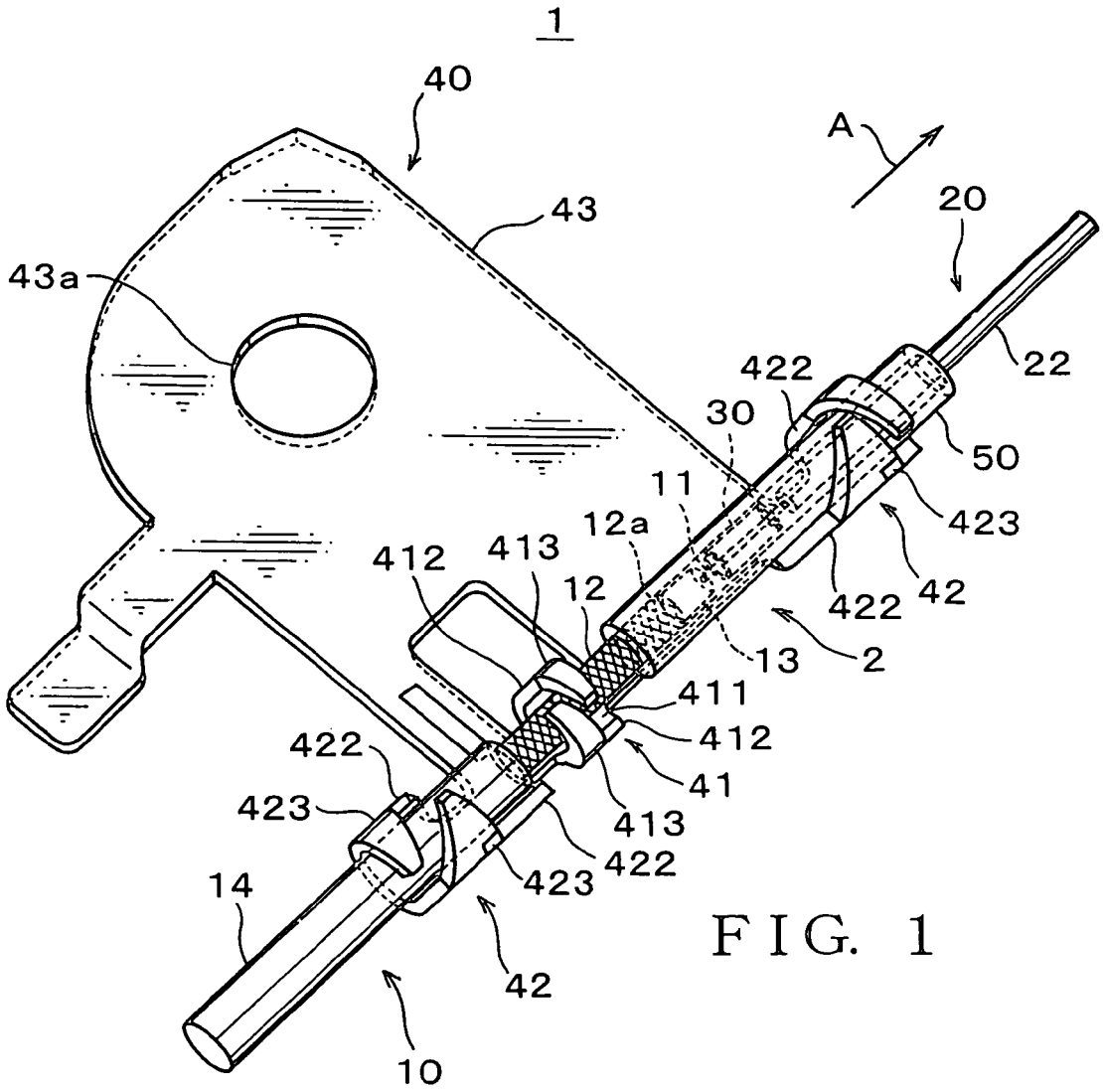
FIG. 1 is a partially perspective view showing a wire-connecting device according to the present invention.

A wire-connecting device 1 according to an embodiment of the present invention will be explained with reference to FIGS. 1 to 6.

In FIGS. 1 to 4, the wire-connecting device 1 includes a coaxial cable 10, a lead wire 20, a joint terminal 30, an earth plate. 40, and a heat-shrinkable member 50 to connect the coaxial cable 10 and the lead wire 20 to each other.

The coaxial cable 10 is, for example, a cable for connecting to an antenna mounted on a vehicle. As well-known, the coaxial cable 10 includes an inner conductor 11, a braided wire 12 surrounding the conductor 11, an insulator 13 made of such as polyethylene and interposed between the conductor 11 and the braided wire 12, and a coating 14 made of such as synthetic resin and covering the braided wire 12.

The lead wire 20 includes a plurality of core wire 21 made of copper, aluminum, or the like, and a coating 22 covering the core wire 21. The joint terminal 30 is an open barrel terminal made of a metal. In the joint terminal 30, the inner conductor 11 of the coaxial cable 10 and the core wire 21 of the lead wire 20 are face to face and crimped together so that the inner conductor 11 and the core wire 21 are electrically connected to each other. Various members such as a hollow sleeve, or an insulating tube can be used as the joint terminal 30 as long as it can electrically connect the inner insulator 11 of the coaxial cable 10 and the core wire 21 of the lead wire 20 to each other.

The earth plate 40 includes a crimping part 41 disposed near the joint terminal 30 for crimping the braided wire 12 of the coaxial cable 10, clamping parts 42, 42 for respectively crimping a coating 14 of the coaxial cable 10 and a coating 22 of the lead wire 20, and a conductive fixing part 43 for being fixed to such as a vehicle body with the crimping terminals 41, 42, 42 crimping the braided wire 12, and the coatings 14, 22.

Figure 3:
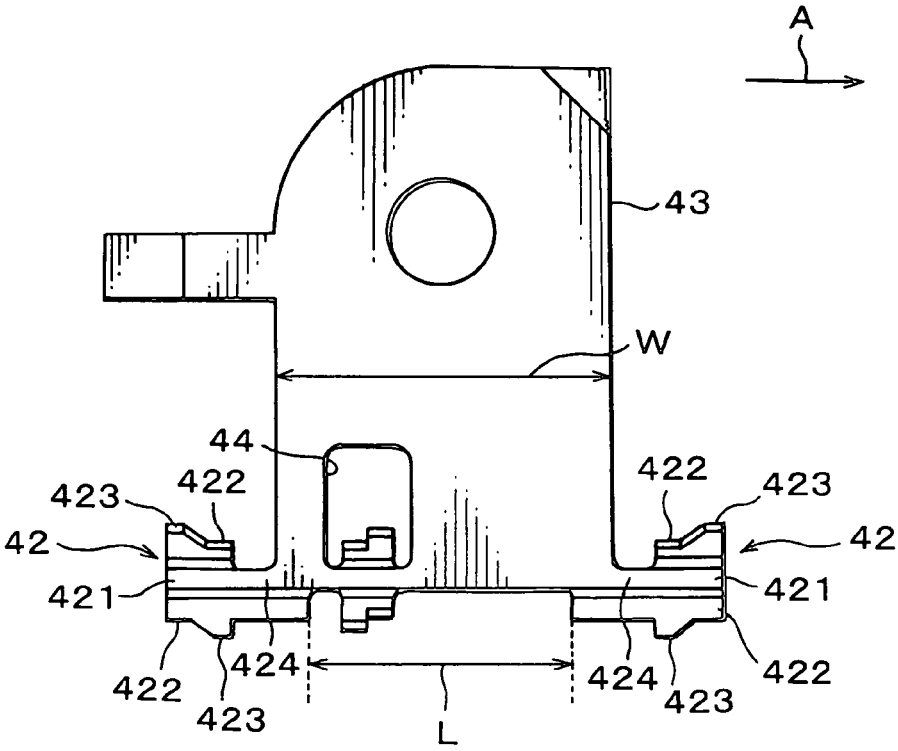
FIG. 3 is a top view showing an earth plate of FIG. 1.

The crimping part 41 includes a connecting part 411, a pair of bases 412*a*, 412*b* and a pair of crimping pieces 413*a*, 413*b*, and is disposed at one side edge of the fixing part 43 (left side in FIG. 1). The connecting part 411 is formed in a substantially rectangular shape, continued to the fixing part 43, and extended to the coaxial cable 10 and the lead wire 20 in a direction A in FIG. 1. A through hole 44 for later described anvil and crimper is formed in the vicinity of the connecting part 411 (FIG. 3).

The pair of bases 412*a*, 412*b* is extended vertically from an edge of the fixing part 43 in the direction A. The pair of the crimping pieces 413, 413 is narrower than the bases 412, 412 and extended from the bases 412, 412. Incidentally, in this embodiment, the crimping pieces 413, 413 are shifted from each other so as not to contact each other. Therefore, when crimping the braided wire 12, contact area between the braided wire and the crimping pieces 413, 413 is large and the braided wire 12 is surely grounded.

The connecting part 411, the pair of bases 412, 412, and the pair of crimping pieces 413, 413 are made by pressing a metal plate for the fixing part 43, as terminals for crimping or holding the braided wire 12.

Each of the clamping parts 42, 42 includes an extended part 421, a pair of bases 422, 422, a pair of clamping pieces 423, 423, and a recess 424. Each extended part 421 is continued to the fixing part 43, and extended from an edge of the fixing part 43.

The pair of bases 422, 422 is extended vertically from an edge of the fixing part 43 in the direction A. The pair of the clamping pieces 423, 423 is narrower than the bases 422, 422 and extended from the bases 422, 422. Incidentally, like the crimping part 41, the clamping pieces 423, 423 are shifted from each other so as not to contact each other. Therefore, when crimping the coatings 14, 22, contact area between the coating 14, 22 and the clamping pieces 423, 423 is large and the coaxial cable 10 and the lead wire 20 are surely grounded.

Each recess 424 is formed in a U-shape slit near the clamping piece 423. Incidentally, the recess 424 may be formed in various shapes such as a V-shape, or a square shape. Further, in this embodiment, the recess 424 is formed at a position where an angle between the base 422 and the clamping piece 423 is substantially right for avoiding shearing. However, the recess 424 may be formed at a position where the angle is obtuse. Thus, the recess 424 prevents the base 422 from being sheared when the clamping piece 423 is crimped. Therefore, crimping pressure capacity can be reduced and a crimping system can be downsized.

The extended part 421, the pair of bases 422, 422, and the pair of clamping pieces 423, 423 are made by pressing a metal plate for the fixing part 43, as terminals for crimping and holding the coatings 22 of the coaxial cable 10 and the coating 22 of the lead wire 20.

Figure 4:
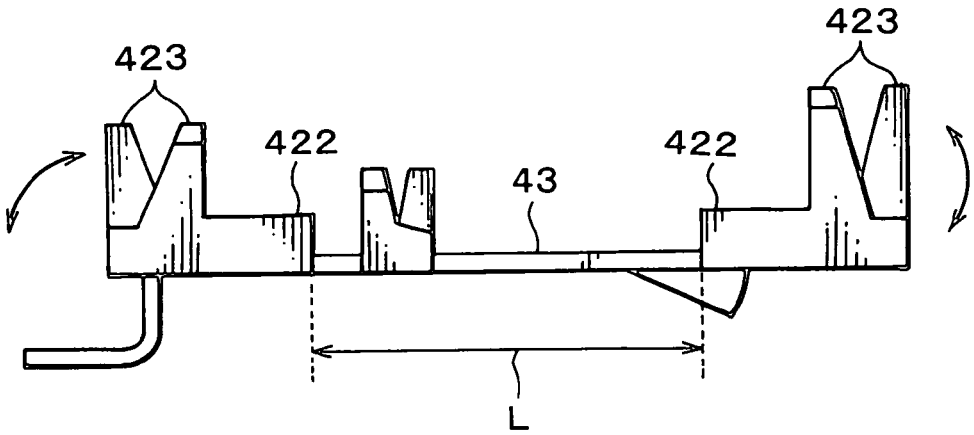
FIG. 4 is a side view showing the earth plate of FIG. 3.
Figure 2:
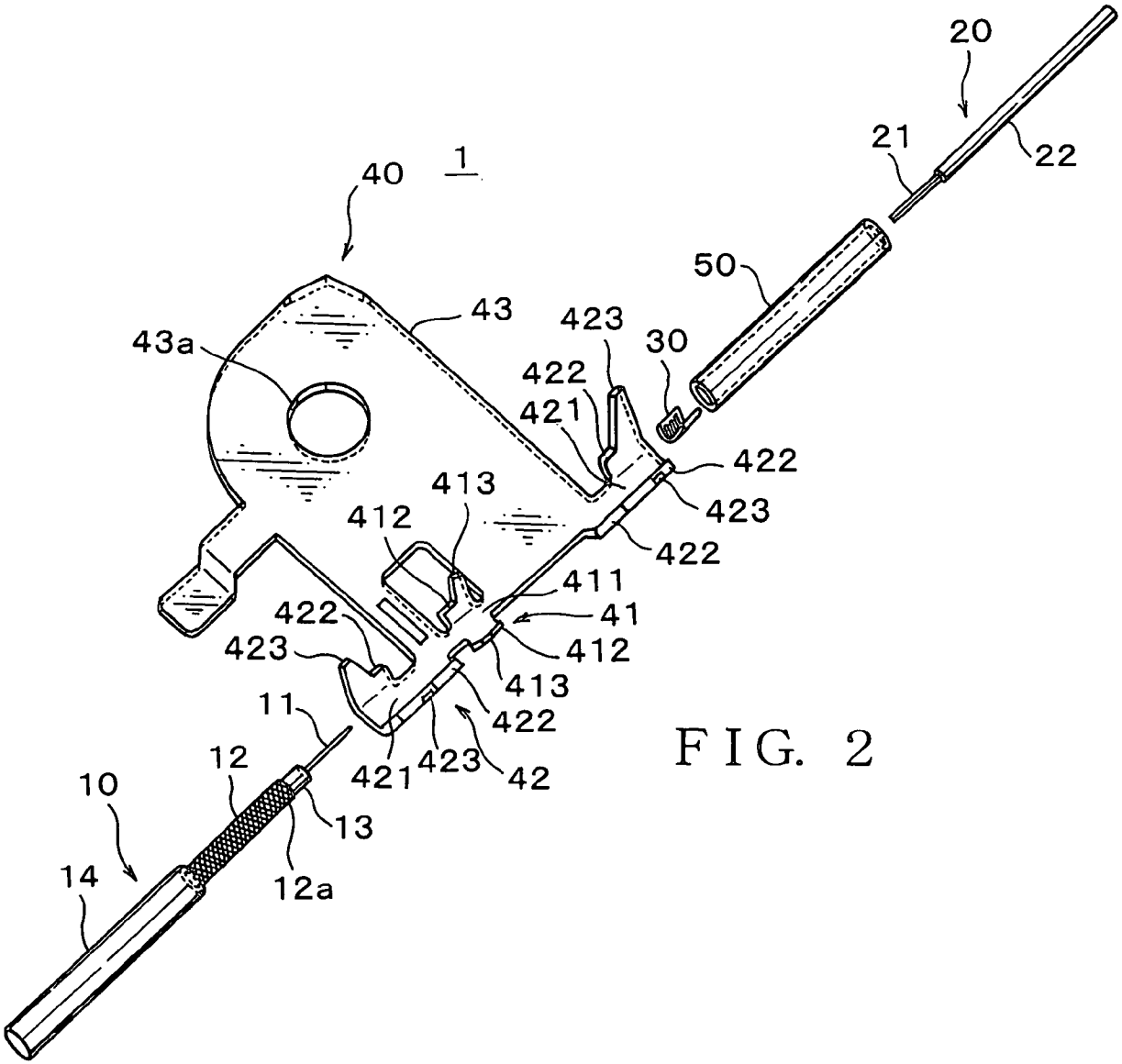
FIG. 2 is an exploded perspective view showing the wire-connecting device of FIG. 1.

As shown in FIGS. 3 and 4, an interval L between the bases 422, 422 is narrower than a width W of the fixing part 43 in the direction A. Therefore, when the clamping pieces 423 are crimped, the bases 422 prevent the fixing part 43 from being deformed.

Incidentally, in this embodiment, the coating 14 is crimped with one of the clamping parts 42, and the coating 22 is crimped with the other clamping part 42. However, the heat-shrinkable member 50 may be crimped, or another clamping part 42 may be provided for crimping the heat-shrinkable member 50.

The fixing part 43 is formed in a substantially square-shape by, for example, pressing a conductive metal plate. A hole 43*a* is formed on a middle of the fixing part 43 for fixing the fixing part 43 to such as a vehicle body with a not-shown screw to ground the fixing part 43 and the crimping part 41.

The heat-shrinkable member 50 is an insulating hear-shrinkable tube, which includes hot-melt adhesive therein. This heat-shrinkable member 50 covers a cut edge 12*a* of the braided wire 12 and the joint terminal 30 and does not cover a part where the crimping part 41 will crimp to prevent the braided wire 12 exposed at the joint terminal 30 from being unbound.

The heat-shrinkable member 50 is transparent. Therefore, even when the heat-shrinkable member 50 covers the cut edge 12*a* and the joint terminal 30, they are visible, and a defective wire-connecting device 1, for example, a disconnected wire-connecting device 1 can be rejected. Since the heat-shrinkable member 50 covers the cut edge 12*a*, folding the mash 12 is unnecessary, and production cost can be reduced.

The heat-shrinkable member 50 determines connecting strength between the coaxial cable 10 and the lead wire 20. Therefore, the heat-shrinkable member 50 can control the connecting strength by changing types or sizes of the heat-shrinkable member 50. Further, owing to the heat-shrinkable member 50, soldering is unnecessary for the fixing part 43. Therefore, production cost and pollution of environment can be reduced.

Next, an embodiment of assembling the wire-connecting device 1 will be explained. Firstly, the inner conductor 11 and the core wire 21 are disposed face to face on the joint terminal 30. Then, the joint terminal 30 is crimped so that the coaxial cable 10 and the lead wire 20 are electrically connected to each other.

As shown in FIG. 1, a combined body 2 is composed of the coaxial cable 10 and the lead wire 20 both of which are covered by the heat-shrinkable member 50. The combined body 2 is made by heating the heat-shrinkable member 50 which covers the mash 12 at the cut edge 12*a*, the core wire 21, the coating 22, and the joint terminal 30.

Figure 5:
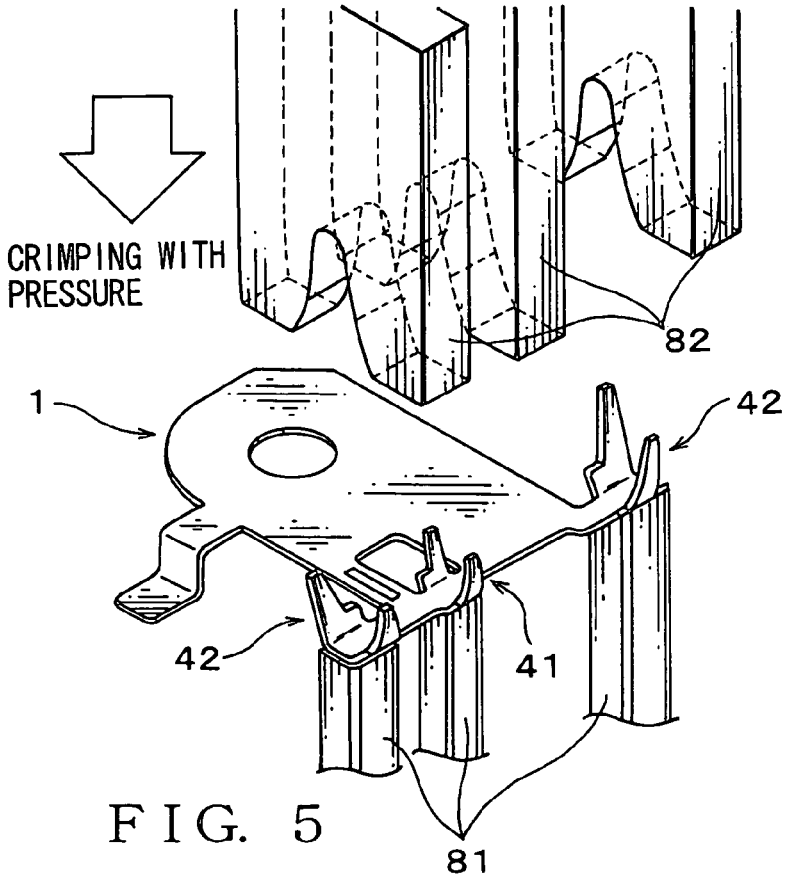
FIG. 5 is an explanatory view of crimping the wire-connecting device.
Figure 8:
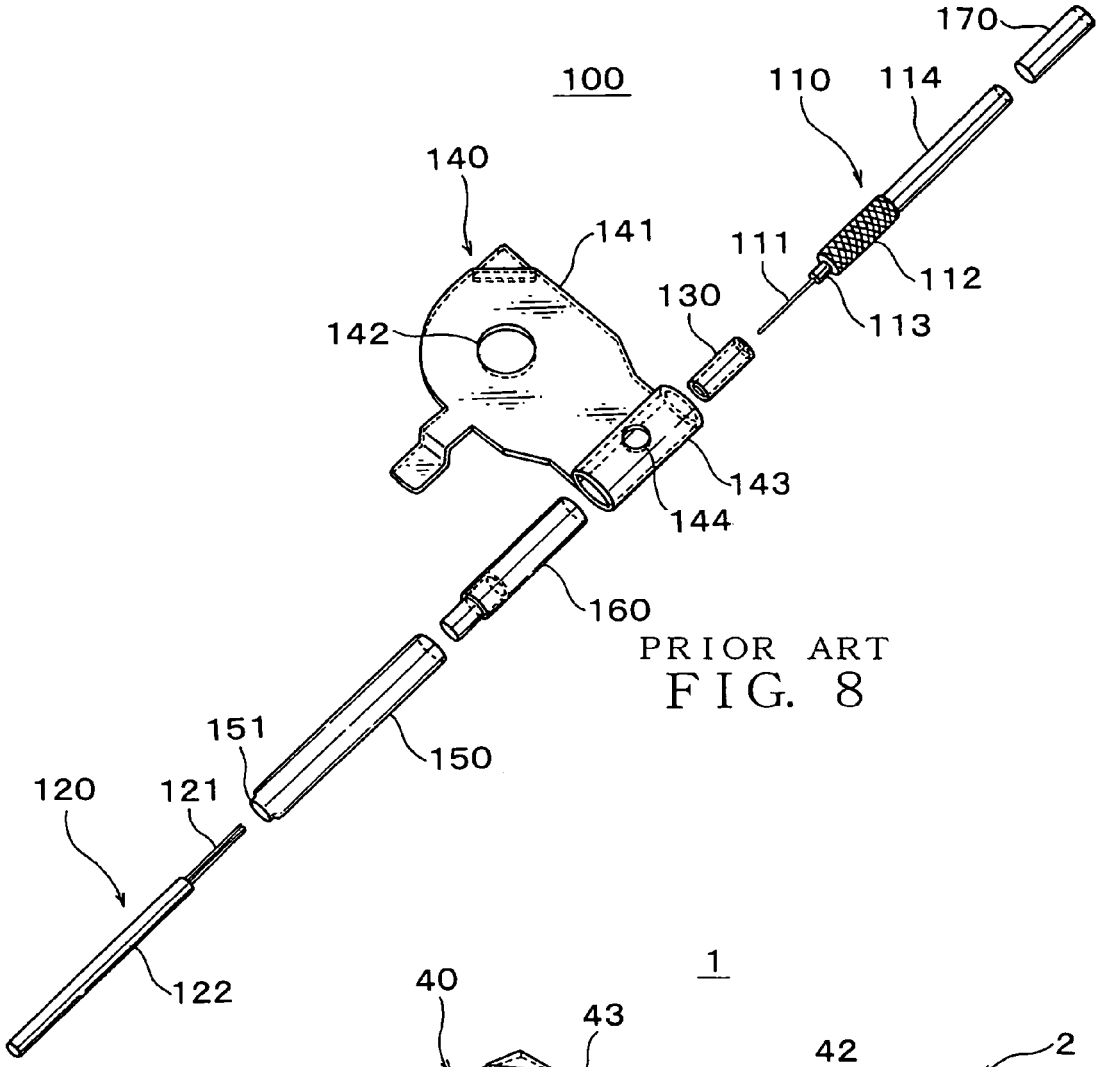
PRIOR ART FIG. 8
FIG. 8 is an exploded perspective view showing the wire-connecting device of FIG. 7.

As shown in FIG. 5, the crimping part 41 and the clamping part 42, 42 are disposed on an anvil 81 of a terminal crimping apparatus (not shown). Incidentally, as well known, in the terminal crimping device, a crimper 82 is pulled down to the anvil 81 to crimp the crimping pieces 413, 423, 423 with the coaxial cable 10 and the lead wire 20.

In this embodiment, the combined body is disposed on the earth plate 40 so that the braided wire 12 exposed from the heat-shrinkable member 50 is positioned on the crimping part 41. Then, the crimper 82 is pulled down to crimp the braided wire 12 with the crimping part 41 and crimp the coatings 14, 22 with the clamping parts 42, 42.

Incidentally, in this embodiment, the crimping part 41 is disposed near one of the edges of the fixing part 41. However, this invention is not limited to this. The crimping part 41 may be interposed at any position in between the clamping parts 42, 42.

Figure 6:
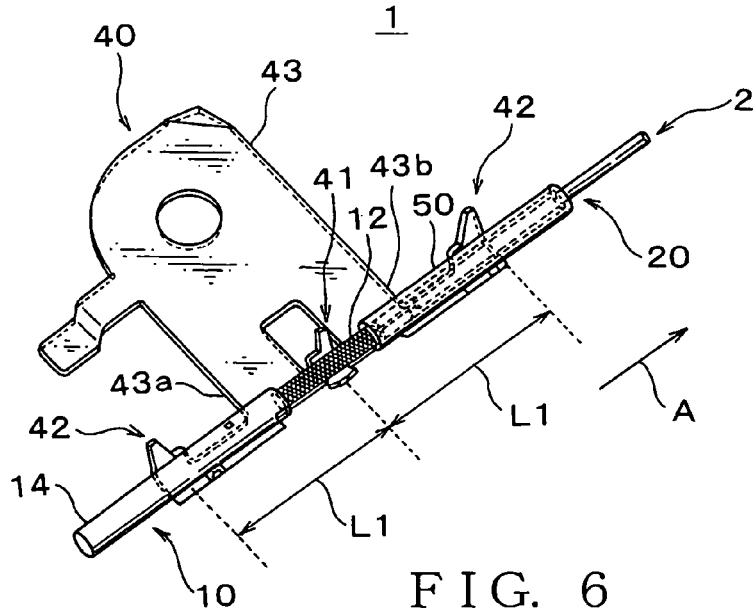
FIG. 6 is an explanatory view of a position of a crimping part relative to a fixing part.
Figure 7:
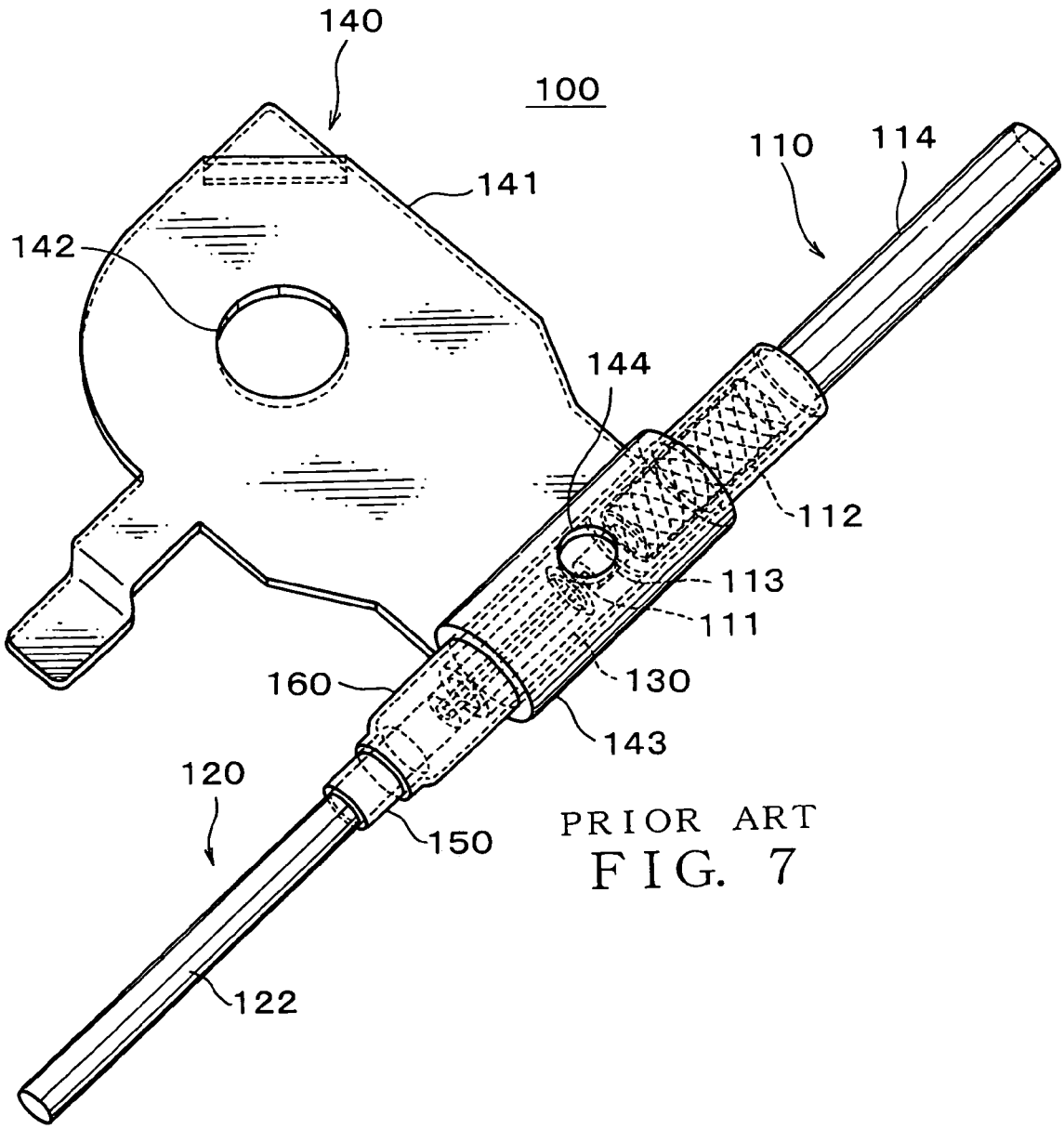
PRIOR ART FIG. 7
FIG. 7 is a partially perspective view showing a conventional wire-connecting device.

FIG. 6 is an explanatory view of a position of the crimping part 41 relative to a fixing part 43. In order to avoid repetitions, identical numerals will be designated by identical reference numerals and only the differences existing in comparison with the above embodiment will be explained.

As shown in FIG. 6, the crimping part 41 is interposed between the clamping parts 42, 42 having the same distance L1 from the crimping part 41. Thus, the braided wire 12 exposed from the heat-shrinkable member 50 is disposed at the center between the clamping parts 42, 42 of the fixing part 43. Therefore, the combined body 2 is easily set on the fixing part 43.

Thus, assembling flexibility is improved. For example, the combined body 2 may be disposed reversely on the earth plate 40. Further, the types of the earth plate 40 may be reduced and commonality of the earth plate 40 may be improved. Therefore, the production cost may be reduced. Incidentally, as for the crimping part 41, there is no problem if the crimping part 41 is interposed in the center between both edges 43*a*, 43*b*.

Further, in this embodiment, three of the crimping part 41 and the clamping parts 42, 42 are used for crimping the combined body 2. However, the number of the clamping parts 42 may be increased or decreased.

Further, in this embodiment, sizes of the clamping parts 42, 42 are different from each other. However, the sizes may be the same. Thus, design flexibility of the combined body 2 and commonality of the wire-connecting device 1 are increased.

Further, in this embodiment, outer diameters of the coaxial cable 10 and the heat-shrinkable member 50 may be the same within a tolerance region. In this case, crimping conditions for both of the clamping parts 42, 42 are the same, and combinations of the anvil 81 and the crimper 82 are only two. Therefore, maintenance ability and the commonality of the wire-connecting device 1 are increased.

Further, in this embodiment, the lead wire is used. However, the present invention is not limited to this. Various coaxial cables can be used. In this case, the heat-shrinkable member 50 covers the both cut edges 12*a* of the braided wire 12 of the coaxial cables.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A wire-connecting device comprising:

a joint terminal for connecting an inner conductor of a coaxial cable and a core wire of an electric wire;

a heat-shrinkable member to be shrunk so as to cover at least the joint terminal and a cut edge of a braided wire of the coaxial cable exposed at the joint terminal; and an earth plate having a fixing part and a pair of clamping parts extending outwardly beyond edges of the fixing part of the earth plate in the axial directions of the coaxial cable and the electric wire, for clamping coatings of the coaxial cable and the electric wire, wherein the edges of the fixing part from which the clamping parts extend are edges facing the axial directions of the coaxial cable and the electric wire.

2. The wire-connecting device as claimed in claim 1, wherein the heat-shrinkable member is transparent to make an inside thereof visible.

3. The wire-connecting device as claimed in claim 1, wherein the earth plate has a crimping part for crimping the braided wire exposed from the heat-shrinkable member for grounding, and the fixing part extends from the crimping part to be fixed on a mating member.

4. The wire-connecting device as claimed in claim 3, wherein a pair of the clamping parts are extended from the fixing part in the axial directions of the coaxial cable and the electric wire, each of said clamping parts disposed in the same interval to the crimping part.

5. The wire-connecting device as claimed in claim 4, wherein each clamping part has an extending part extended from the fixing part in the axial directions of the coaxial cable and the electric wire, a base extending vertically from an edge of the extending part, a clamping piece being narrower than the base, and extending from the base, and a recess disposed between the fixing part and the clamping piece, wherein the recess is defined by an edge of the fixing part and an edge of the clamping part.

6. The wire-connecting device as claimed in claim 5, wherein an interval between the bases of the clamping parts is narrower than a width of the fixing part along the axial directions of the coaxial cable and the electric wire.

* * * * *